US005507641A

United States Patent [19]

Cline

[11] Patent Number: 5,507,641

[45] Date of Patent: Apr. 16, 1996

[54] DEVICE FOR CLEANING AN ANIMAL'S TEETH

[76] Inventor: Michelle T. Cline, 6 Peacock Hill, Sharon, Mass. 02067

[21] Appl. No.: 264,608

[22] Filed: Jun. 23, 1994

[51] Int. Cl.[6] ..... A61D 5/00; A46B 9/04

[52] U.S. Cl. ..... 433/1; 15/167.1; 15/246

[58] Field of Search ..... 433/1; 15/143.1, 15/167.1, 167.2, 227, 246

[56] References Cited

U.S. PATENT DOCUMENTS

| | | | |
|---|---|---|---|
| 1,645,965 | 10/1927 | Neumerkel | 15/227 |
| 1,650,200 | 11/1927 | Dougan | 15/246 X |
| 2,122,743 | 7/1938 | Hasse | 15/246 |
| 2,497,749 | 2/1950 | Wagner | 2/16 |
| 2,722,703 | 11/1955 | Green | 15/143 |
| 2,802,229 | 8/1957 | Bangs | 15/143 |
| 2,968,827 | 1/1961 | Lawsine et al. | 15/227 |
| 3,007,441 | 11/1961 | Eyer | 119/1 |
| 3,968,950 | 7/1976 | Gallo | 248/359 |
| 4,283,808 | 8/1981 | Beebe | 15/167.1 X |
| 4,558,483 | 12/1985 | Noser | 15/143.1 X |
| 4,683,592 | 8/1987 | Strongwater | 15/227 X |
| 4,751,762 | 6/1988 | Meimeteas | 15/246 |
| 4,984,299 | 1/1991 | Halldorsdottir | 2/16 |
| 5,115,530 | 5/1992 | Distiso | 15/143.1 X |
| 5,273,425 | 12/1993 | Hoagland | 433/1 |
| 5,361,446 | 11/1994 | Rufo | 15/167.1 |

*Primary Examiner*—Nicholas D. Lucchesi
*Attorney, Agent, or Firm*—Steven N. Fox

[57] ABSTRACT

Disclosed is a device for use by a person to clean the teeth of a domestic animal. The device generally comprises an elongated member having first and second ends and a median portion. The device further comprises a brushing head disposed at the second end and a shield mounted at the median portion which substantially encloses the first end.

2 Claims, 1 Drawing Sheet

DEVICE FOR CLEANING AN ANIMAL' S TEETH

FIELD OF THE INVENTION

The present invention relates generally to devices for the care of animals such as dog and cats. More particularly, the present invention relates to devices adapted to clean the teeth of such animals.

BACKGROUND OF THE INVENTION

It is well known that domestic animals such as dogs or cats should have their teeth cleaned regularly to prevent the build-up of plaque and tartar which lead to tooth loss as well as aid in fresh breath. In many cases, however, and for a variety of reasons, the pet owner is reluctant to personally clean the animal's teeth. There are many reasons for such reluctance, including the risk of injuring the animals teeth or surrounding gums. In instances where the pet owner desires to have the animal's teeth cleaned, the pet owner typically elects to take the animal to a veterinarian or professional groomer who are skilled in the cleaning process.

Several devices have been developed for cleaning the teeth of domestic animals. One such device is that disclosed by U.S. Pat. No. 3,007,441 which discloses a toothbrush consisting of a brushing head 10 attached to one end of a handle 11. The brushing head 10 consists of a plurality of conically shaped teeth 13 and cylindrical shaped teeth 14. The cortically shaped teeth 13 and cylindrical shaped teeth 14 provide a toothbrush which can effectively clean the teeth of a animal and which thereafter can be easily cleaned.

U.S. Pat. No. 5,273,425 discloses a portable instrument for cleaning the teeth of an animal. The device consists of a brushing head 1 connected to an elongated handle portion 5. The abrasive brushing head 1 is made up of abrasive mineral particles which facilitate the cleaning of the animal's teeth.

Conventional toothbrushes of the type described above all share several drawbacks. First, such conventional devices do not prevent the person's hand and the toothbrush handle from becoming wet during the cleaning process. As such, the person may loose a secure grip on the handle thereby causing the toothbrush to slip within the animal's mouth and accidentally injure the animals's teeth or gums. Additionally, some animals do not enjoy the cleaning process and attempt to avoid the same by biting, scratching or otherwise preventing the person from inserting the toothbrush within the animal's mouth. In such cases, the animal may cause injury to the person's hand.

One object of the present invention is to develop a toothbrush which prevents the person's hand from becoming wet during the cleaning process thereby allowing the person to safely clean the animal's teeth.

Another object of the present invention is to develop a toothbrush which will protect the person's hand should the animal decide to bite, scratch or otherwise disrupt the cleaning precess.

SUMMARY OF THE PRESENT INVENTION

The present invention is a device which allows a person to safely clean the teeth of a domestic animal such as dog or cat. The device generally comprises an elongated member having a handle which may be grasped by a person and a brushing head adapted to clean the animal's teeth. The device further comprises a shield or cover secured to the elongated member between the handle portion and the brushing head. The shield is of cylindrical shape and encloses the handle to thereby prevent moisture from coming in contact with the handle during the cleaning process.

BRIEF DESCRIPTION OF THE DRAWINGS

The following detailed description of the present invention will be better understood with reference to the accompanying drawings in which.

DETAILED DESCRIPTION OF THE PREFERRED EMBODIMENTS

Figure 1:
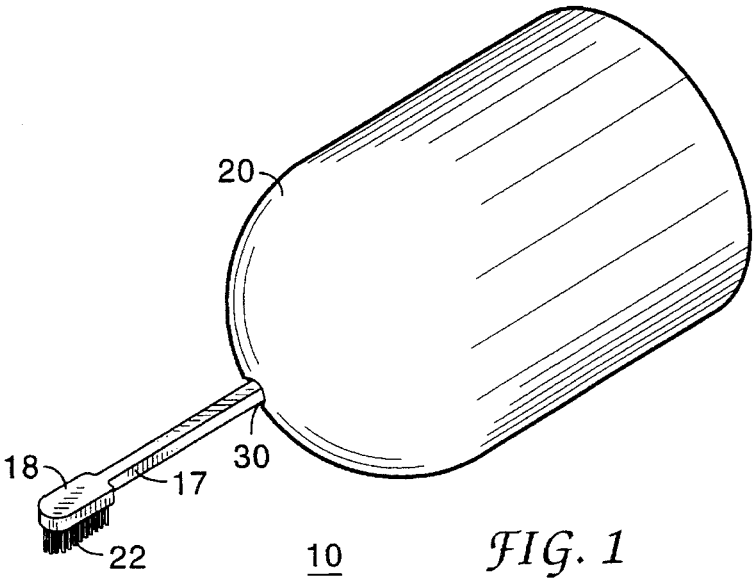
FIG. 1 is a perspective view of the device of the present invention.
Figure 2:
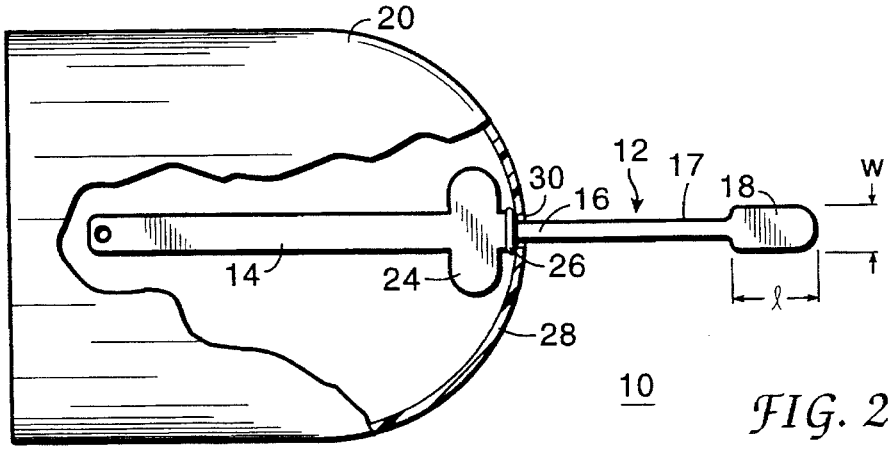
FIG. 2 is partial cut-away view of the device of the present invention.
Figure 3:
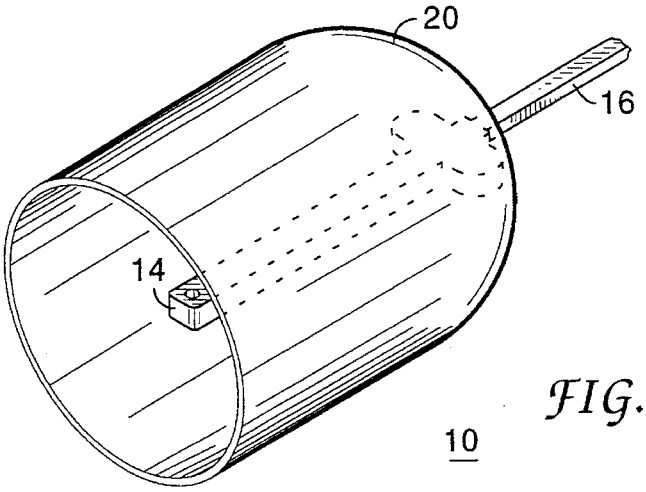
FIG. 3 is a perspective view of the device of the present invention.

Referring to FIGS. 1–3, wherein one embodiment of the device 10 of the present invention is shown. In this embodiment, the device 10 generally comprises an elongated member 12 having a handle portion 14, a median portion 16 and an end portion 17. Disposed at the end portion 17 is a brushing head 18 having a plurality of soft and pliable bristles 22. The brushing head 18 is defined by an overall length 1 and an overall width w. The dimensions of the length l and the width w are selected such that the brushing head can be easily inserted within the mouth of a domestic animal such as dog or cat. Moreover, the dimensions of length l and width w are such that the brushing head can be inserted directly on the teeth of the animal without injuring the gums of the animal.

The handle portion 14, median portion 16, and the end portion 17 are preferably made from one piece of material by, for example, a molding process. Alternatively, handle portion 14 and median portion 16/end portion 17 may be formed as a separate pieces. In this embodiment, the median portion 16/end portion 17 may include a screw or other male type fastener which can be engaged with a receptacle or threaded hole provided on the handle portion 14. The shield 20 could then be inserted between the handle portion 14 and the median portion 16/end portion 17 for assembly. Additionally, the elongated member 12 has been shown as a substantially straight member. Alternatively, and by way of example only, the end portion 17 could be angled relative to the handle portion 14 and median portion 16 to thereby enhance the ability of the person to insert the device 10 within the mouth of the animal.

The device 10 further comprises a protective shield or cover 20 which is preferably connected at the median portion 16 of the elongated member 12. The shield 20 has a thin outer wall 28 and is made from a flexible and waterproof material. The shield 20 is provided with an opening 30 so that the shield 20 may be inserted over the brush head 18 and then secured to the median portion 16 by conventional means such as an adhesive agent. The device 10 may further comprise a support member 24 disposed at the median portion 16. The support member 24 may be formed with a flange portion 26 which can be used to secure the shield 20. The support member 24 may also be used as a thumb rest when the person grasps the handle portion 14.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for use by a person to clean the teeth of a domestic animal such as a dog or cat, the device comprising: an elongated member having first and second ends and a median portion, a brushing head disposed at said second end, a support member disposed at said median portion, and a shield mounted to said median portion and substantially enclosing said first end and having an opening adjacent the first end such that a person may substantially grasp said first end and be protected by said shield.

2. The device of claim 1, wherein said shield comprises a first end secured to said median portion.

* * * * *